US005209492A

United States Patent [19]

Hamilton

[11] Patent Number: 5,209,492

[45] Date of Patent: May 11, 1993

[54] SHOOTING TARGET STAND

[76] Inventor: Phillip D. Hamilton, 8917 Butte Rd., Sweet, Id. 83670

[21] Appl. No.: 902,948

[22] Filed: Jun. 22, 1992

[51] Int. Cl.[5] ..... F41J 1/10

[52] U.S. Cl. ..... 273/407; 248/463

[58] Field of Search ..... 273/407; 248/463

[56] References Cited

U.S. PATENT DOCUMENTS

| | | | |
|---|---|---|---|
| 2,899,204 | 8/1959 | Ratay | 273/407 X |
| 3,080,166 | 3/1963 | Clark | 273/407 |
| 3,868,630 | 2/1975 | Lesondak | 340/119 |
| 4,029,318 | 6/1977 | Boss | 273/407 X |
| 4,637,615 | 1/1987 | Foreman | 273/407 |
| 4,811,956 | 3/1989 | Foreman | 273/407 |
| 4,836,542 | 6/1989 | Crawley | 273/55 B |
| 4,878,303 | 11/1989 | Banniza et al. | 40/606 |
| 4,880,194 | 11/1989 | Geise et al. | 248/463 X |
| 5,067,683 | 11/1991 | Wagner | 273/407 X |
| 5,083,390 | 1/1992 | Edman | 40/606 |

*Primary Examiner*—William H. Grieb

*Attorney, Agent, or Firm*—Frank J. Dykas; Craig M. Korfanta; Ken J. Pedersen

[57] ABSTRACT

Embodiments are shown and described, each of a shooting target stand for removable holding a target at various angles and heights relative to the ground. The target stand has a generally two-dimensional frame, with an opening across which the target is placed, and a bottom edge for setting on the ground. The target stand has a pivotal member, which pivotally and lockably attaches near the bottom edge of the frame and props the frame into an upright position. The pivotal member preferably is as thin and two-dimensional as the frame and pivots into the frame opening to be coplanar with the frame and to make the target stand compact for transport and storage. The preferred embodiment is made of straight lengths of widely-available PVC piping, coupled together. The target is attached to the target stand preferably with semi-cylindrical clips that snap on to the frame.

11 Claims, 2 Drawing Sheets

SHOOTING TARGET STAND

BACKGROUND OF THE INVENTION

1. Technical Field

The disclosed invention relates generally to marksmanship and target shooting accessories and specifically to portable stands for removably holding a target.

2. Background Art

Recreational marksmen, policemen, and military personnel practice using their shooting skills by shooting at movable and replaceable targets. The target is placed at a distance, shot at once or several times, checked for aiming accuracy, and usually replaced with another target. A stand is needed to hold the target at a distance without interfering with the target or crossing the path of the bullet. It is common to attach the target to a bale of hay or straw or to a cardboard box. These objects are heavy and/or clumsy to carry, maneuver, and store and they are not always easily available. These objects also do not easily allow the target angle or height to be adjusted.

Several stands, which have been designed to hold signs, displays, or nets, could possibly be adapted to hold a shooting target. U.S. Pat. No. 3,868,630 (Lesondak) discloses a portable traffic barricade, which displays an attention-attracting panel that freely hangs from the top bar of the barricade. The barricade rests on two inverted T-shaped legs. U.S. Pat. No. 4,878,303 (Banniza, et al.) discloses a portable sign including a frame holding a removable display surface. The frame rests on two support bases, each having two legs that extend down on either side of the sign to rest on the ground. The legs may be shortened or lengthened to raise or lower the sign. U.S. Pat. No. 5,083,390 (Edman) discloses a modular sign with an H-shaped metal frame with pointed legs that can be driven into the earth. Alternatively, inverted T-shaped legs may be attached to the frame for resting on the floor. U.S. Pat. No. 4,836,542 discloses a football kicking practice frame for holding a net. The frame has a rigid, generally rectangular base from which vertical members rise to hold the net.

What is still needed is a simple and lightweight stand that can be easily folded and made portable. The stand needs to be adjustable to hold the target at various angles and heights.

DISCLOSURE OF INVENTION

This invention is a portable shooting target stand comprising a frame, a pivotal member, and an attachment means for detachably and adjustably fastening a target to the frame. The frame is generally a flat or two-dimensional structure lying on a plane. The frame has an opening through the plane, which receives a generally planar target. The target extends across the opening, is generally coplanar with the frame, and is fastened at its perimeter edges to the frame. At the outer perimeter of the frame is a bottom base edge on which the frame rests on the ground. The pivotal member is pivotally connected to the frame near the base edge and extends at an adjustable angle from the frame to contact the ground and to hold the frame and attached target in a generally upright, but adjustable, position. The pivotal member is attached in such a way that, once adjusted, the pivotal member and frame remain securely fixed in position relative to each other while in use or being carried.

The frame may be two upright target support bars connected by a transverse base to which the pivotal member is connected. The attachment means may be semi-cylindrical clips that snap around the target support bars to grip the target edge securely between the clip and the support bar. The pivotal member may be about the same thickness as the frame and may be pivoted into the opening to lie on the same plane as the frame.

The invention is compact and easily portable and storable, which benefits marksmen or hunters who might be traveling on foot and soldiers or policemen who might need to use and transport a great number of target stands. The target stand also has the flexibility to hold the target at various angles or heights relative to the ground.

BEST MODE FOR CARRYING OUT INVENTION

Figure 1:
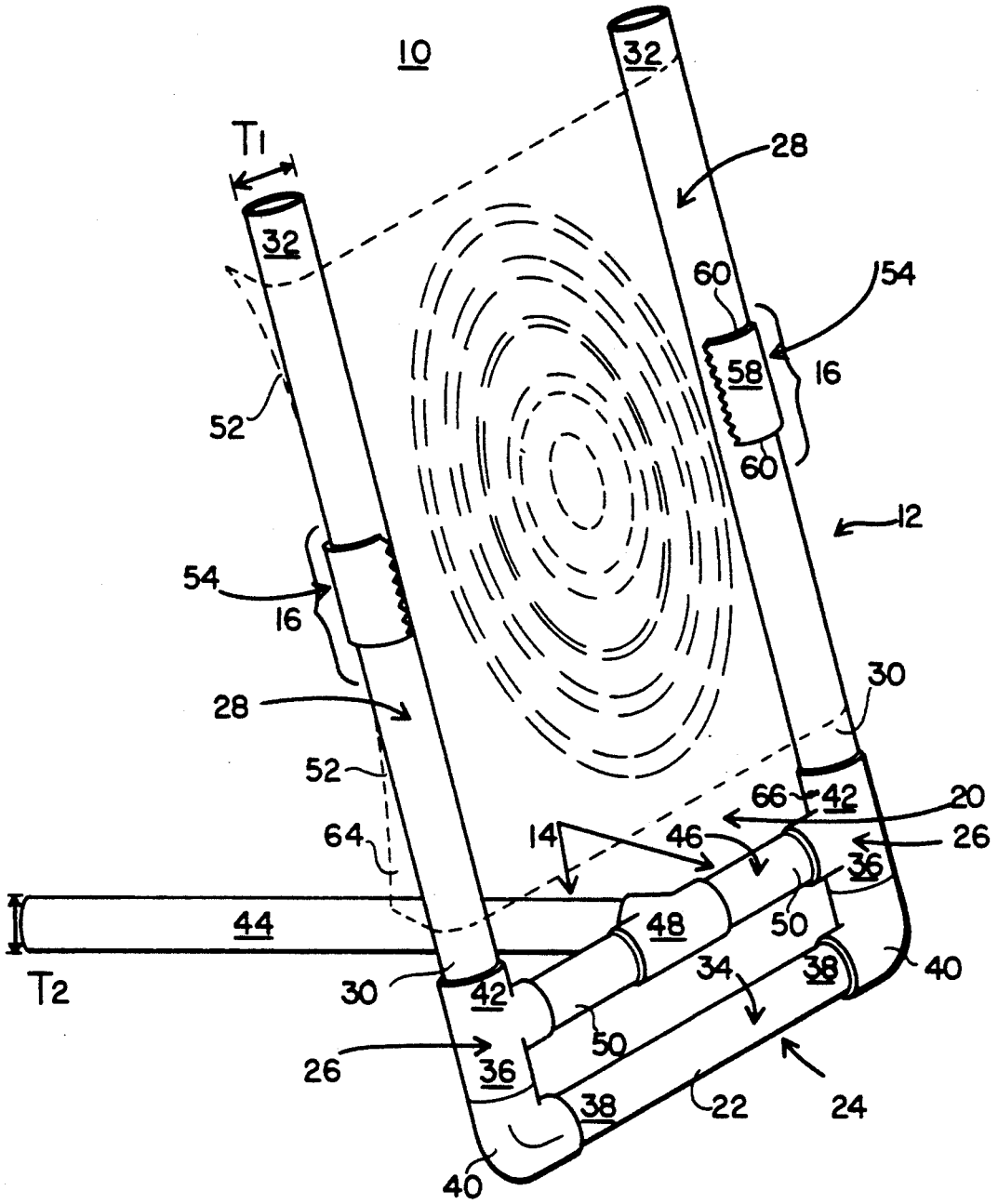
FIG. 1 is a perspective view of one embodiment of the shooting target stand invention holding a target in a generally upright position.
Figure 4:
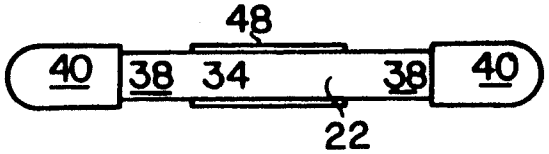
FIG. 4 is a bottom view of one embodiment of the shooting target stand invention folded for transport or storage.
Figure 5:
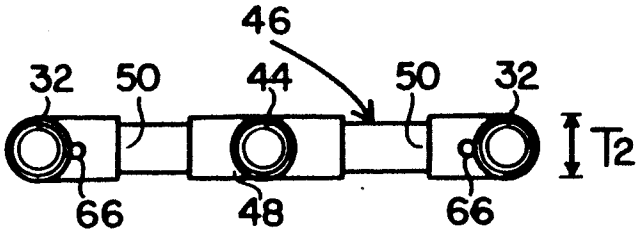
FIG. 5 is a top view of one embodiment of the shooting target stand invention folded for transport or storage.
Figure 3:
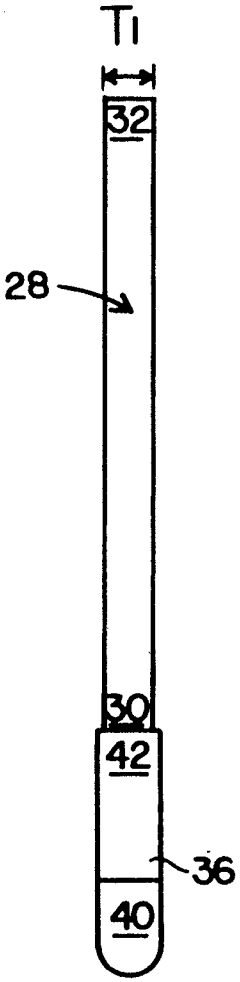
FIG. 3 is a side view of one embodiment of the shooting target stand invention folded for transport or storage and without the clips.
Figure 2:
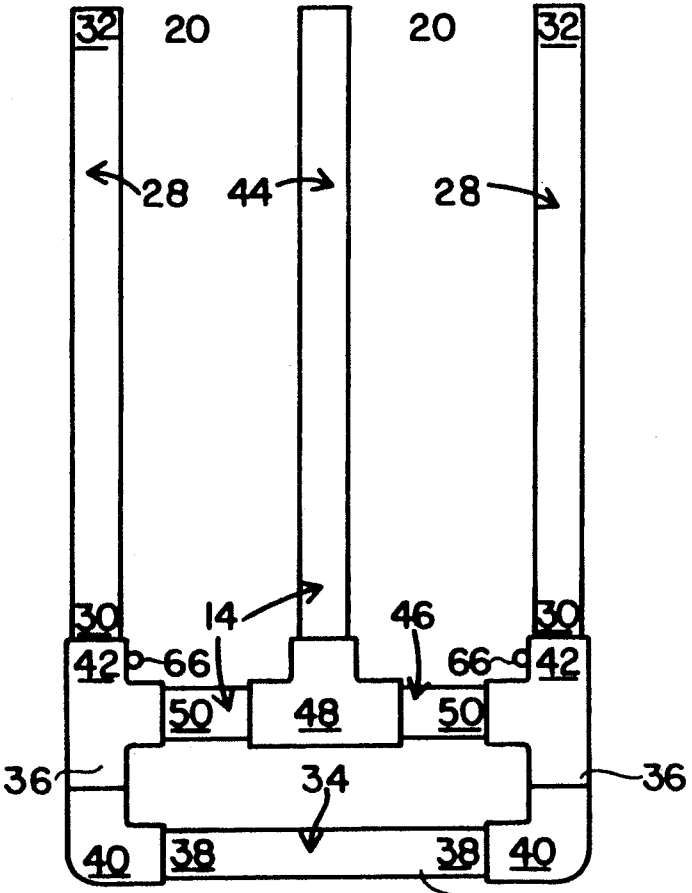
FIG. 2 is a front view of one embodiment of the shooting target stand invention folded for transport or storage and without the clips.

Referring to FIGS. 1 - 5, there is shown and described the preferred, but not the only, embodiment of the shooting target stand invention. The shooting target stand 10 comprises a frame 12, a pivotal member 14, and an attachment means 16 for fastening a target 18 to the frame 12. The target stand 10 is designed so that no part of the target stand 12 crosses or extends into the normal path of a bullet or projectile. The normal path is in the area directly in front of and in back of the target 18, where the back of the target 18 or frame 12 is defined as the side facing the pivotal member 14 when the target stand 10 is in use.

The frame 12 is generally two-dimensional in that it defines a two-dimensional plane and is made of material that has a small thickness $T_1$ relative to the length and width of the frame 12. The frame 12 has an opening 20 through the plane it defines, across which is placed the target 18 or other generally planar sheet. The frame 12 may be of various shapes and designs, as long as it has the opening 20 for receiving the target 18, a bottom base edge 22 for resting on the ground or other surface, and a center of gravity with the target attached that generally lies over or in back of the base edge 22.

The frame 12 may comprise a transverse base 24, having two opposing ends 26 as well as the said bottom base edge 22, and two elongated target support bars 28, having anchor ends 30 and opposing extension ends 32. Each support bar anchor end 30 is connected to one transverse base opposing end 26, and the support bars extend up from the transverse base 24 to hold the target 18. In the preferred embodiment, the transverse base 24 further comprises a transverse base bar 34 and two vertical side bars 36 which act as the said transverse base opposing ends 26. The base bar 34 has two opposing ends 38 and a bottom surface that is the said base edge 22. Each of the two side bars 36 has a bottom end 40 and an opposing top end 42, with the bottom end 40 attached to one of the base bar opposing ends 38 and the top end 42 attached to the anchor end 30 of one of the support bars 28. The target support bars 28 extend up from the side bar top ends 42 in generally coplanar and perpendicular relationship to the transverse base 24 and, more specifically, to the base bar 34. The target support bars 28 do not need to be exactly parallel to each other or exactly perpendicular to the transverse base 24, as long as they are positioned so that, when the target 18 is attached, the center of gravity of the frame 12 and target 18 combination is generally over or in back of the base edge 22. This keeps the frame 12 and target 18 from tipping over sideways when the target stand 10 is set up on the ground or other surface. In some embodiments, non-parallel target support bars 28 would be advantageous to hold an unusually-shaped target 18.

In the preferred embodiment, the pivotal member 14 comprises a stand bar 44 and a transverse stand bar connector 46. The stand bar 44 is rigidly connected to the center 48 of the stand bar connector 46. The stand bar connector 46 is connected to the vertical side bars 36, with each one of two opposing ends 50 of the stand bar connector 46 being pivotally and lockably received by side bars 36 near the side bar top end 42. In this way, the combination of the stand bar 44 and the stand bar connector 46 pivots relative to the transverse base 24 or, more specifically, relative to the side bars 36 and the base bar 34. The stand bar 44 extends out to contact the ground or other surface to prop or support the frame 12 in a generally upright position.

In an optional embodiment, the pivotal member 14 comprises only the stand bar 44, which is pivotally connected to the center 48 of the transverse stand bar connector 46. The stand bar connector 46 is rigidly connected to the side bars 36 near the top end 42, and therefore is considered part of the transverse base 24. In this embodiment, therefore, the stand bar 44 pivots relative to the stand bar connector 46 and relative to the entire transverse base 24. In this and in the preferred embodiment, the pivotal member 14 is connected to the transverse base 24 by means of a friction fit between piping and couplings. This friction fit allows the pivotal member 14 to pivot when significant manual pressure is purposely applied but to stay in place when the target stand 10 is in use or is being carried. Optionally, the pivotal member 14 can be attached by any pivotable and lockable manner. The pivotal aspect of the connection allows the user to pivot the pivotal member 14 to adjust the angle of the frame 12 and target 18 relative to the ground and to fold up the target stand 10. The locking aspect of the connection allows the target stand 10 to rigidly stay in the desired position once it has been set up for use or folded.

Preferably, the stand bar 44, or other pivotal member 14, folds or pivots into the opening 20 and is about the same thickness $T_2$ as the support frame thickness $T_1$. This creates a particularly compact, flat, and generally two-dimensional single unit for transport and storage, as shown in FIGS. 2–5.

The attachment means 16 removably fasten the outer perimeter edge 52 of the target 18 to the frame 12 so that the target 18 is generally coplanar with the frame 12. In the preferred embodiment, the attachment means 16 fastens the target edge 52 to the target support bars 28 and the support bars 28 are cylindrical. The preferred attachment means 16 is a plurality of clips 54, each being defined by a semi-cylindrical wall with a concave inner surface 56, a convex outer surface 58, two opposing arc ends 60, and two side edges 62. Each clip 54 has a circumferential arc length greater than about a half circle, a diameter less than the diameter of the target support bar 28, and a distance between side edges 62 that is less than the diameter of the target support bar 28. Also, each clip 54 is resilient to the extent that the side edges 62 may be spread apart to a distance slightly more than the diameter of the support bar 28 and, when the spreading pressure is released, the side edges 62 tend to spring back to their original position. These features allow the clips 54 to snap on to and around the target support bar 28 so that the inner surface 56 and the side edges 62 exert pressure on the support bar 28 and on the target edges 52. When the user wants to attach a target 18 to the target stand 10, he wraps the target edge 52 partially or all the way around the target support bar 28, and snaps on the clips 54 around the support bar 28 and target edge 52. The resilience of the clip 54 and the fact that the clip 54 is sized to be of smaller cylindrical dimensions that the support bar 28 make the clip 54 tightly grip the target 18 between the clip 54 and the support bar 28. The clips 54 may be moved up and down the support bars 28 or may be used to grip only part of the target 18. For example, the clips 54 may be positioned close to the extension ends 32 of the support bars 28 to grip just the target bottom section 64 to hold the target 18 generally up above the target stand 10. Optionally, one or more side edge 62 of each clip 54 may be cut to be serrated, which improves the tightness of the grip of the clip 54.

The shooting target stand 10 is preferably made of PVC (polyvinylchloride) piping joined by plastic couplings. PVC piping has a safety advantage because it shatters when hit by a bullet, rather than causing the bullet to ricochet. Various lengths of straight piping can be coupled together to make the preferred embodiment. Preferably all the couplings are glued to make the target stand 10 rigid, except for the couplings enabling the pivotal member 14 to pivot and except for the couplings joining the target support bars 28 to the transverse base 24. By using a pin 66 or other removable fastening device, the support bars 28 are made easily removable and replaceable in case they are damaged by bullets or other projectiles.

While there is shown and described the present preferred embodiment of the invention, it is to be distinctly understood that this invention is not limited thereto but may be variously embodied to practice within the scope of the following claims.

I claim:

1. A shooting target stand for placement on the ground for supporting a generally planar target with outer perimeter edges, the shooting target stand comprising:

a generally two-dimensional frame defining a plane, the frame having an opening through the plane, for receiving a target in generally coplanar relationship to the frame, and the frame having a perimeter bottom base edge for resting on the ground;

attachment means for detachably fastening the edges of the target to the frame; and a pivotal member pivotally and lockably connected to the frame near the base edge and extending from the frame to contact the ground, for supporting the frame at an adjustable angle relative to the stand member and relative to the ground, whereby the target stand holds the target at a variety of angles and does not cross directly in back of the target.

2. A shooting target stand as set forth in claim 1, wherein the pivotal member is about equal in thickness to the frame and pivots into the frame opening to be coplanar with the frame, whereby the target stand can be folded into a generally flat shape without being dismantled.

3. A shooting target stand for placement on the ground for supporting a generally planar target with outer perimeter edges, the shooting target stand comprising:

a generally two-dimensional frame comprising:

a transverse base, having two opposing ends and a bottom base edge for resting on the ground, and two elongated target support bars each having an anchor end and an opposing extension end, each support bar being connected at the anchor end to one of the transverse base opposing ends, and each support bar upending from the transverse base coplanar with the transverse base and with the other support bar, and the two target support bars defining a space between them for receiving a target in generally coplanar relationship to the frame, attachment means for detachably fastening the edges of the target to the target support bars, and a pivotal member pivotally and lockably connected to and extending from the transverse base to contact the ground, for supporting the frame at an adjustable angle relative to the pivotal member and relative to the ground, whereby the target stand can hold the target at a variety of angles and does not cross directly in back of the target.

4. A shooting target stand as set forth in claim 3, wherein the pivotal member is about the same thickness as the frame and pivots into the space between the target support bars to be coplanar with the frame, whereby the target stand can be folded into a flat shape without being dismantled.

5. A shooting target stand as set forth in claim 4, wherein each target support bar is removably connected to the transverse base.

6. A shooting target stand as set forth in claim 4, wherein each target support bar is an elongated cylinder with two opposing ends, with one end being the said anchor end.

7. A shooting target stand as set forth in claim 6, wherein the attachment means comprises a plurality of clips, each being defined by a semi-cylindrical wall having an inner surface, an outer surface, two opposing arc ends, and two side edges, the clip inner surface being adapted to curve around one of the cylindrical target support bars with the target edge positioned in between the clip inner surface and the support bar.

8. A shooting target stand as set forth in claim 7, wherein the circumferential arc length of the clip is greater than about a half circle, the distance between the clip side edges is less than the diameter of the cylindrical support bar and the clip wall is resilient, so that the side edges may be temporarily spread apart to snap the clip on to and around the support bar.

9. A shooting target stand as set forth in claim 8, wherein a clip side edge is serrated, for secure gripping of the target edge in between the clip and the support bar.

10. A shooting target stand as set forth in claim 4, wherein:

the transverse base member further comprises a transverse base bar with two opposing ends and a bottom surface that is the said base edge, and two vertical side bars, each having a bottom end and an opposing top end, each bottom end being connected to one of the base bar ends and each top end being connected to the anchor end of one of the target support bars, and the pivotal member further comprises a stand bar rigidly connected to a transverse stand bar connector, the stand bar connector located above and generally parallel to the base bar, the stand bar connector having a center and two opposing ends, each opposing end pivotally and lockably connected to one of the two side bars near the top end of the side bars, whereby the stand bar rigidly connects to a stand bar connector that pivots relative to the transverse base.

11. A shooting target stand as set forth in claim 4, wherein the transverse base further comprises:

a transverse base bar with two opposing ends and a bottom surface that is the said base edge;

two vertical side bars, each having a bottom end and an opposing top end, each bottom end being connected to one of the base bar ends and each top end being connected to the anchor end of one of the target support bars; and a transverse stand bar connector located above and generally parallel to the base bar, the stand bar connector having a center and two opposing ends, each opposing end rigidly connected to one of the two side bars near the top end, and the stand bar connector center pivotally and lockably receiving the pivotal member, whereby the pivotal member pivots relative to the stand bar connector.

* * * * *